US009169708B2

(12) United States Patent
Devilleger

(10) Patent No.: US 9,169,708 B2
(45) Date of Patent: Oct. 27, 2015

(54) METHOD OF IN SITU REPAIR OF A WELLHEAD BASE FLANGE

(75) Inventor: Denis Devilleger, Marcq (FR)

(73) Assignee: STORENGY, Bois Colombes (FR)

( * ) Notice: Subject to any disclaimer, the term of this patent is extended or adjusted under 35 U.S.C. 154(b) by 0 days.

(21) Appl. No.: 13/420,667

(22) Filed: Mar. 15, 2012

(65) Prior Publication Data

US 2012/0240373 A1 Sep. 27, 2012

(30) Foreign Application Priority Data

Mar. 25, 2011 (FR) ..... 11 52482

(51) Int. Cl.

| | |
|---|---|
| ***F16L 55/16*** | (2006.01) |
| ***F16L 55/00*** | (2006.01) |
| ***B23P 6/00*** | (2006.01) |
| ***B29C 73/00*** | (2006.01) |
| ***E21B 33/03*** | (2006.01) |
| ***E21B 33/04*** | (2006.01) |

(52) U.S. Cl.

CPC ..... *E21B 33/03* (2013.01); *E21B 33/04* (2013.01); *Y10T 29/49718* (2015.01); *Y10T 29/53* (2015.01)

(58) Field of Classification Search

CPC ..... E21B 33/03; E21B 33/04; Y10T 29/53; Y10T 29/49718

USPC ..... 29/402.01, 402.02, 402.09, 402.12, 29/402.13, 402.18, 458; 138/99; 285/15, 285/290.1

See application file for complete search history.

(56) References Cited

U.S. PATENT DOCUMENTS

| | | | | |
|---|---|---|---|---|
| 1,913,778 | A * | 6/1933 | Ukropina | 285/290.1 |
| 2,667,865 | A * | 2/1954 | Herman | 126/263.01 |
| 3,563,276 | A * | 2/1971 | High et al. | 138/99 |
| 4,003,430 | A | 1/1977 | Carnahan | |
| 4,166,479 | A * | 9/1979 | Cleavenger | 138/97 |
| 4,390,186 | A | 6/1983 | McGee et al. | |
| 4,552,183 | A * | 11/1985 | Chick | 138/99 |
| 4,673,122 | A * | 6/1987 | Dubey | 228/119 |
| 4,852,913 | A * | 8/1989 | Brooks | 285/15 |
| 5,345,972 | A * | 9/1994 | Goglio et al. | 138/99 |
| 5,690,148 | A * | 11/1997 | Ziu | 138/171 |
| 6,217,688 | B1 * | 4/2001 | Landers | 156/94 |
| 6,321,491 | B1 * | 11/2001 | DiMauro | 52/20 |
| 6,385,899 | B1 * | 5/2002 | Treganza | 47/39 |
| 6,997,260 | B1 * | 2/2006 | Trader et al. | 166/277 |
| 7,168,743 | B2 * | 1/2007 | Nadarajah et al. | 285/15 |
| 7,472,476 | B2 * | 1/2009 | Gronquist | 29/825 |

(Continued)

FOREIGN PATENT DOCUMENTS

| | | |
|---|---|---|
| CA | 1289869 C | 1/1991 |
| CA | 2 104 695 A1 | 6/1993 |
| FR | 2 297 990 A1 | 8/1976 |
| FR | 2 637 316 A1 | 4/1990 |

*Primary Examiner* — Essama Omgba
*Assistant Examiner* — Darrell C Ford
(74) *Attorney, Agent, or Firm* — Leydig, Voit & Mayer, Ltd.

(57) ABSTRACT

An in situ method for repairing a base flange of a wellhead. At least one layer of a polymerizable composite material is applied to a damaged surface, an elastic seal is placed on the layer of composite material, and a reinforcing collar is pressed against the seal on the surface of the flange covered with the composite material. An arrangement of an in situ repair of a base flange of a wellhead includes at least one layer of a polymerized composite material on a damaged surface, an elastic seal on the composite material, and a reinforcing collar pressing the seal against the damaged surface.

21 Claims, 2 Drawing Sheets

(56) References Cited

U.S. PATENT DOCUMENTS

Figure 1:
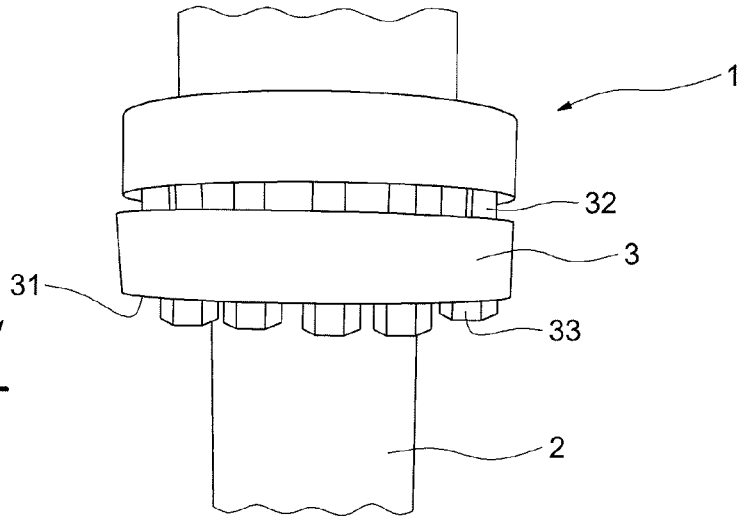

| | | | | |
|---|---|---|---|---|
| 7,472,722 | B2 * | 1/2009 | Nadarajah et al. | 138/99 |
| 7,673,654 | B2 * | 3/2010 | Rice | 138/99 |
| 8,113,242 | B1 * | 2/2012 | Bennett | 138/99 |
| 2004/0016467 | A1 * | 1/2004 | Blackmore et al. | 138/99 |
| 2008/0216938 | A1 * | 9/2008 | Rice | 156/77 |
| 2010/0012215 | A1 * | 1/2010 | Morton et al. | 138/99 |
| 2010/0089484 | A1 | 4/2010 | Courtois et al. | |
| 2011/0284115 | A1 * | 11/2011 | Venero et al. | 138/99 |

* cited by examiner

METHOD OF IN SITU REPAIR OF A WELLHEAD BASE FLANGE

FIELD OF THE INVENTION

The present invention relates to an in situ repair method for a base flange of a wellhead as well as an arrangement for the in situ repair of such a flange.

BACKGROUND

The base flange of a wellhead is the element that makes it possible to provide the junction and ensure sealing between a tubing that comes from the bottom of the well and a surface facility from which connecting pipes convey what is produced by the well, for example oil, gas or water, to a distribution grid.

The base flange, which is installed during construction of the well, may undergo deteriorations over time, in particular due to corrosion, resulting from leaks. When the base flange must be restored, it is necessary to stop the well, purge it, and disassemble the wellhead to be able to restore the base flange and adjacent elements, in particular the tube on which the wellhead is mounted, or, if applicable, install new pieces.

Stopping a well being expensive, it is only possible in exceptional cases. Thus, the repair of a base flange of a wellhead is considered impossible.

SUMMARY OF THE INVENTION

The aim of the invention is to propose a solution to this problem.

The aim of the invention is achieved with an in situ repair method for a base flange of a wellhead, comprising at least the following steps:

applying at least one layer of a polymerizable composite material on the damaged and then pickled surfaces of the base flange and an adjacent piece with which the base flange is in contact, generally the tube on which the wellhead is mounted, placing an elastic seal on the layer of composite material, when the latter is polymerized, at the junction between the base flange and the adjacent piece, placing a reinforcing collar adapted to press the seal on the surface covered with the composite material of the flange.

According to different possible embodiments, the method according to the invention can also comprise at least one of the following steps:

before application of a layer of polymerizable composite material on the damaged surface of the base flange and the adjacent piece:

pickling the damaged surface, applying a layer of an anti-corrosion product on the pickled surface;

after the application of a layer of polymerizable composite material on the damaged surface and before placement of the elastic seal:

applying several layers of the composite material to prepare a bed for the elastic seal;

after placement of the elastic seal and before placement of the reinforcing collar:

applying at least one layer of composite material on either side of the seal;

when the base flange is placed on a tubing comprising a double wall below the flange, the space between the two walls for example being filled with cement:

placing an annular foam bead on the filling of the space between the two tubes and pouring an epoxy resin crown on the bead so that it has an upper surface sloped toward the outside of the tubing in order to avoid water stagnation and corrosion.

The aim of the invention is also achieved with an arrangement for the in situ repair of a base flange of a wellhead, which comprises at least one layer of a polymerized composite material applied on the damaged and previously pickled surfaces of the base flange and an adjacent piece such as the tube on which the wellhead is mounted, respectively, an elastic seal intended to be placed on the composite material previously applied when the latter is polymerized, at the junction between the base flange and the adjacent piece, and a reinforcing collar configured to press the seal on the damaged surface.

This arrangement can also comprise, when the base flange is placed on a tubing comprising a double wall below the flange, the space between the two walls for example being filled with cement, an annular foam bead on the cement filling and an epoxy resin crown poured on the bead so that it has an upper surface sloping toward the outside of the tubing.

Other features and advantages of the present invention will appear from the description below of one embodiment of the method according to the invention.

BRIEF DESCRIPTION OF DRAWINGS FIGURES

The description is done in reference to the appended drawings, in which

Figure 2:
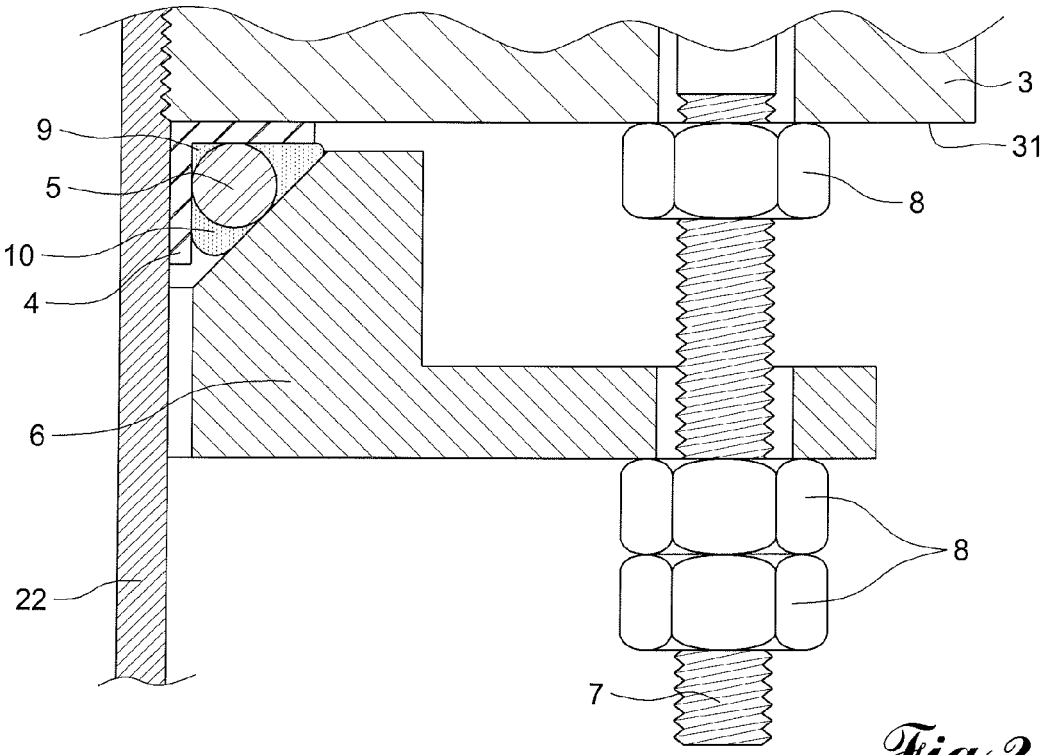
Figure 3:
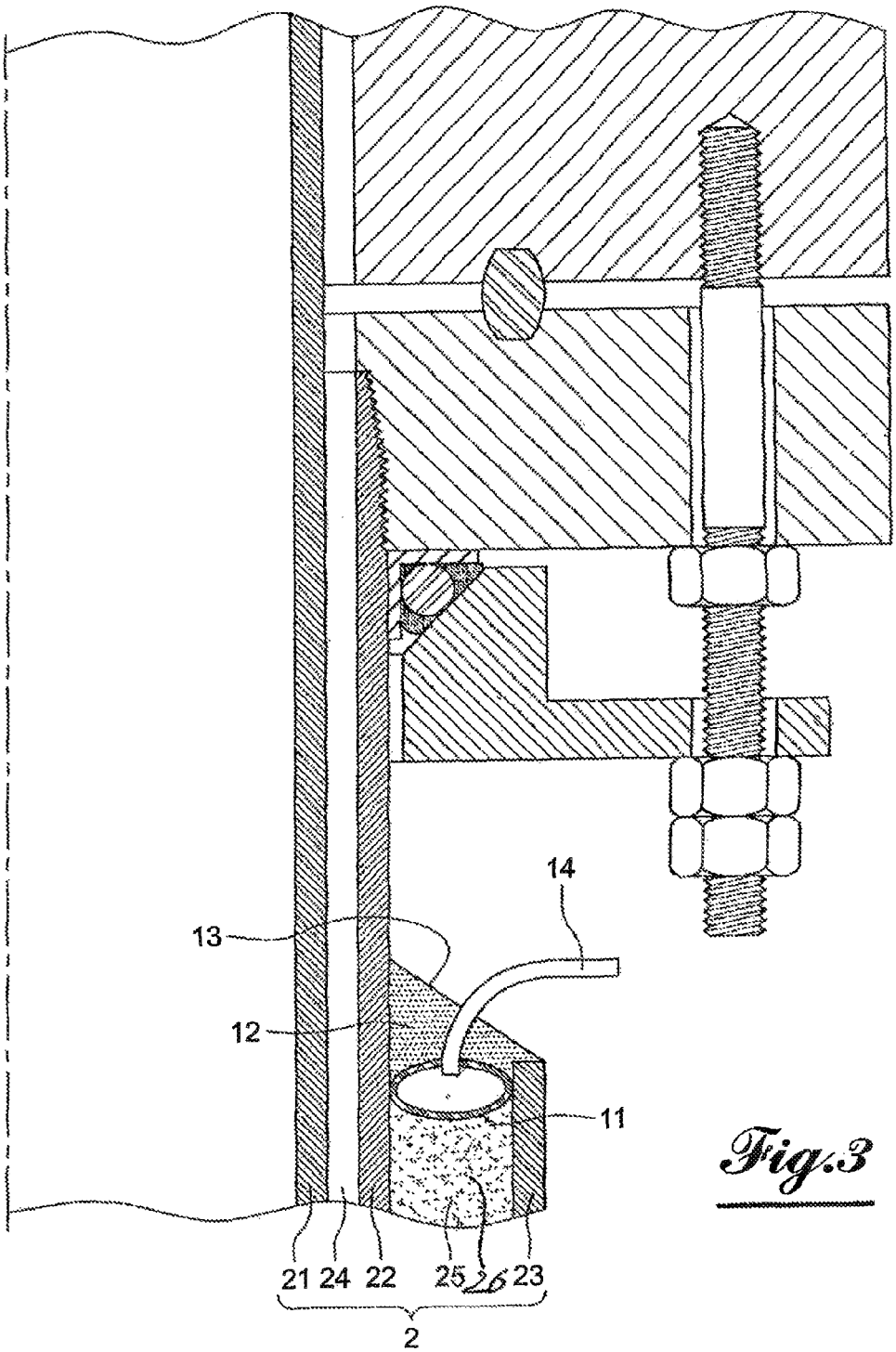

FIG. 1 is a diagrammatic perspective view of the bottom portion of a wellhead, FIG. 2 is a cross-sectional view of the junction between a wellhead and the tubing of the well, and FIG. 3 is a cross-sectional view of the position of the base flange relative to the back of the cave of the connector.

DETAILED DESCRIPTION

According to the repair method covered by the present invention, the repair of the base flange of a well is done in situ, i.e. without disassembling the wellhead. The well therefore remains operational.

The damage to be repaired generally being situated below the base flange, more particularly at the junction between the base flange and the tubing on which the wellhead is engaged, the repair consists of removing the traces of corrosion, protecting the cleaned surface with a suitable coating, and applying a polymer resin or any other polymerizable composite material suitable to protect the flange from being accessed by corrosive vapors or liquids.

The design of a well to which the repair method according to the invention applies is visible in FIG. 1. A wellhead 1 is fixed on a production pipe or tubing 2 coming from the bottom of the well through a base flange 3. The flange 3 comprises a lower surface 31 on which the heads 33 of screws 32 by which the flange 3 is fixed to the wellhead 1 bear upon tightening. The lower surface 31 can be at a right angle, as in the appended drawings, but also at obtuse angles of up to about 160°.

As shown in FIG. 3, a gas well can be provided with a triple tubing 2 comprising a gas production tube 21, an intermediate tube 22 on which the base flange 3 is screwed, and an outer tube 23. This triple tubing 2 constitutes two security annuluses 24, 25 to prevent the escape of gas and pollution from the environment.

The first annulus 24 is situated between the production tube 21 and the intermediate tube 22. This annulus is filled with water and must not be pressurized. If, on the contrary, this annulus is pressurized, this indicates a leak at one of the elements at the bottom of the well.

The second annulus 25 is situated between the intermediate tube 22 and the outer tube 23 and is filled with cement 26.

If, over time, a leak arises at the bottom of the well, the gas rises to the surface through the first annulus 24 and reaches the base flange 3 level. The junction threading between the intermediate tube 22 and the base flange 3 not necessarily being sealed, the leak arises at the surface in the cave. More particularly, corrosion occurs on the lower surface 31 of the flange 3, but also on the outer wall of the intermediate tube 22, close to the junction between the flange 3 and the tube 22. The invention proposes to seal this leak by applying one or more polymer layers 4 framing an O-ring 5, the whole being compressed by a metal reinforcing collar 6 forced by studs 7 that replace the screws 32 by which the base flange 3 is initially secured with the wellhead 1.

At the very beginning of the repair, the corroded surfaces of the flange 3 and the tube 22 are pickled and carefully cleaned, in particular degreased, so as to then be able to apply a composite polymer repair material, in particular an elastomer, to two components. The pickling is advantageously done by sandblasting or grit blasting with particles fine enough to obtain a roughness in the vicinity of 75 micrometers of the surface of the tube 22 and the surface 31 of the flange 3.

Then, the pickled surfaces are treated with an anti-corrosion coating to prevent any new corrosion until a composite protective material is applied.

Afterward, the composite repair material, which is advantageously an elastomer polymer material with two components, is applied on the surfaces to be treated in one or more layers 4 according to the indications by the material's manufacturer, in particular relative to the polymerization duration and temperature determined by the manufacturer. The first of the three mandatory steps of the inventive method is characteristic of the method according to the invention, the pickling and anti-corrosion steps being able to be modified depending on the specific nature and extent of the particular damage to be repaired.

In the following step, the site provided for the O-ring 5 is prepared by filling a zone 9 situated between the screw pitch of the tube 22 and the site of the O-ring with several layers of polymer repair composite materials, according to the stipulations by the manufacturer of the composite material.

Then, the O-ring 5, which is for example made from nitrile, is placed in the angle formed by the lower surface 31 of the base flange 3 and the outer surface of the tube 22.

When the O-ring 5 is in place, the place present on either side of the O-ring is filled with at least one, generally several layers 10 of composite elastomer polymer repair materials. Lastly, to keep the O-ring 5 in place and press it against the layers 4 of composite materials, the reinforcing collar 6, which itself is protected from corrosion by a coating, is positioned below the base flange 3. The reinforcing collar 6, which is designed in two half-shells to be able to place it around the flange 3, is kept on the studs 7 using nuts 8 whereof the first nut secures the corresponding stud 7 in the base flange 3 and whereof two other nuts, used as nut/locknut, secure the collar 6 on the corresponding stud 7 as shown in FIGS. 2 and 3.

Subsequently, as shown in FIG. 3, if over time a leak is observed in the second annulus 25, a sealing device is made with an annular bead 11 made from polyurethane foam and a cast crown 12 made from epoxy resin so that, when the resin is set, it has an upper surface 13 sloping toward the outside of the tube 23 so as to prevent water stagnation and corrosion. A small tube 14 is mounted in the bead 11 so as to capture the gas to monitor whether there is a pressure increase or to analyze the gas or determine the leakage rate. A valve and a pressure gauge are mounted on the free end of the small tube 14.

The invention claimed is:

1. A method of in-situ repair of a wellhead assembly, the wellhead assembly including a base flange and a tube having an outside surface and a longitudinal axis, extending from beneath and toward the base flange, and engaging the base flange, wherein the base flange surrounds and extends radially outwardly, at a planar lower surface of the base flange, from the outside surface of the tube, a damaged surface area to be repaired is located at a junction of the planar lower surface of the base flange and the outside surface of the tube, and includes part of the planar lower surface of the base flange and part of the outside surface of the tube, with both the part of the outside surface and the part of the planar lower surface adjacent to the junction, and the planar lower surface of the base flange forms a corner having an angle of at least 90 degrees and up to 160 degrees with the outside surface of the tube, the method comprising:

applying a layer of a polymerizable composite material on the damaged surface area at the junction of the planar lower surface of the base flange and the outside surface of the tube, covering the damaged surface area, wherein the layer of a polymerizable composite material comprises layer portions that cover adjacent portions of the planar lower surface of the base flange and of the outside surface of the tube and are disposed within the corner formed by the planar lower surface of the base flange and the outside surface of the tube;

placing a single elastic seal ring on the outside surface of the tube, coaxial with the longitudinal axis of the tube, on the layer of the polymerizable composite material, in contact with the layer portions of the polymerizable composite material, covering the damaged surface area on the parts of the planar lower surface of the base flange and the outside surface of the tube, and opposite the junction, wherein the single elastic seal ring engages the layer of the polymerizable composite material within the corner; and installing a reinforcing collar on the tube, coaxially surrounding the tube, in contact with the single elastic seal ring, pressing the single elastic seal ring toward the junction, against the layer portions of the polymerizable composite material, and pressing the layer portions of the polymerizable composite material onto the parts of the planar lower surface of the base flange and of the outside surface of the tube.

2. The method according to claim 1, further comprising:

before applying the layer of the polymerizable composite material to the damaged surface area, pickling the damaged surface area, and applying a layer of an anti-corrosion product to the damaged surface area that has been pickled.

3. The method according to claim 2, further comprising, after applying the layer of the polymerizable composite material to the damaged surface area, and, before placing the single elastic seal ring, applying additional layers of the polymerizable composite material to prepare a bed for the single elastic seal ring.

4. The method according to claim 3, further comprising, after placing the single elastic seal ring and before installing the reinforcing collar, applying at least one layer of the polymerizable composite material on both sides of the single elastic seal ring.

5. A well, repaired using the method according to claim 1.

6. The method according to claim 1, including applying additional layers of the polymerizable composite material to the damaged surface area, thereby preparing a bed for the single elastic seal ring.

7. The method according to claim 1, including providing the reinforcing collar with an oblique face and installing the reinforcing collar so that the oblique face is oblique with respect to the planar lower surface of the base flange and presses the single elastic ring seal toward the junction.

8. A method of in-situ repair of a wellhead assembly disposed above a well, for repairing leakage of a gas which rises from the well, wherein the wellhead assembly includes a base flange, a production tube passing through the base flange, an intermediate tube surrounding the production tube and engaged with the base flange, an outer tube ending at a location below and spaced from a lower surface of the base flange so that an annular volume is defined between the intermediate tube and the outer tube, and a filler material filling part of the annular volume, the method comprising:

placing an annular foam bead on the filler material, between the intermediate and outer tubes, and between the filler material and the lower surface of the base flange;

inserting a first end of a gas transmission tube into the annular foam bead, with a second end of the gas transmission tube disposed outside the annular foam beam for transmitting the gas rising from the leak and passing through the annular foam bead; and pouring an epoxy resin onto the annular foam bead, thereby forming an epoxy resin crown on the annular foam bead so that the gas transmission tube extends through the crown and the crown has an upper surface sloped outwardly from an outside surface of the intermediate tube toward an outside surface of the outer tube to avoid water stagnation between the intermediate tube and the outside tube and to avoid corrosion of the intermediate tube and the outer tube.

9. A well, repaired using the method according to claim 8.

10. The method of claim 8, further including repairing a damaged surface area located at a junction of the lower surface of the base flange and an outside surface of the intermediate tube and including a part of the lower surface of the base flange and the outside surface of the intermediate tube, wherein the lower surface of the base flange extends radially outwardly from the outside surface of the intermediate tube at the junction, and the lower surface of the base flange forms a corner having an angle of at least 90 degrees and up to 160 degrees with the outside surface of the intermediate tube, the method comprising:

applying a layer of a polymerizable composite material on the damaged surface area at the junction of the lower surface of the base flange and the outside surface of the intermediate tube, covering the damaged surface area and adjacent portions of the lower surface of the base flange and of the outside surface of the intermediate tube, within the corner formed by the lower surface of the base flange and the outside surface of the intermediate tube;

placing a single elastic seal ring on the outside surface of the intermediate tube and coaxial with the intermediate tube, on the layer of the polymerizable composite material, in contact with the layer of the polymerizable composite material, on the damaged surface area on the lower surface of the base flange and the outside surface of the intermediate tube, and opposite the junction, wherein the single elastic seal ring engages the layer of polymerizable composite material within the corner; and installing a reinforcing collar on the intermediate tube, coaxially surrounding the intermediate tube, in contact with the single elastic seal ring, pressing the single elastic seal ring toward the junction, against the layer of polymerizable composite material on portions of the lower surface of the base flange, and onto portions of the outside surface of the intermediate tube.

11. The method according to claim 10, further comprising:

before applying the layer of the polymerizable composite material to the damaged surface area, pickling the damaged surface area, and applying a layer of an anti-corrosion product to the damaged surface area that has been pickled.

12. The method according to claim 11, further comprising, after applying the layer of the polymerizable composite material to the damaged surface area, and, before placing the single elastic seal ring, applying additional layers of the polymerizable composite material to prepare a bed for the single elastic seal ring.

13. The method according to claim 12, further comprising, after placing the single elastic seal ring and before installing the reinforcing collar, applying at least one layer of the polymerizable composite material on both sides of the single elastic seal ring.

14. The method according to claim 10, including providing the reinforcing collar with an oblique face and installing the reinforcing collar so that the oblique face is oblique with respect to the planar lower surface of the base flange and presses the single elastic ring seal toward the junction.

15. An arrangement providing an in-situ repair of a wellhead assembly, the wellhead assembly including a base flange and a tube having an outside surface and a longitudinal axis, extending from beneath and toward the base flange, and engaging the base flange, wherein the base flange has a planar lower surface surrounding and extending radially outward from a junction with the outside surface of the tube and forming a corner at the junction and that has an angle of at least 90 degrees and up to 160 degrees between the planar lower surface of the base flange and the outside surface of the tube, the arrangement comprising:

at least one layer of a polymerized composite material on a previously pickled and damaged surface area at the junction of the planar lower surface of the base flange and the outside surface of the tube, wherein the damaged surface area includes part of the planar lower surface of the base flange and a part of the outside surface of the tube, within the corner formed by the planar lower surface of the base flange and the outside surface of the tube;

a single elastic seal ring disposed on the outside surface of the tube and coaxial with the longitudinal axis of the tube, on the layer of the polymerized composite material, on the damaged surface area on the parts of the planar lower surface of the base flange and the outside surface of the tube, opposite the junction, and engaging the layer of polymerized composite material within the corner; and a reinforcing collar coaxially surrounding the tube and in contact with the single elastic seal ring, wherein the reinforcing collar presses the single elastic seal toward the junction, against the layer of polymerizable composite material and includes a surface that is oblique to the outside surface of the tube and the planar lower surface of the base flange, and that presses the single elastic seal ring against the damaged surface area.

16. A well comprising an arrangement according to claim 15.

17. The arrangement according to claim 15, including studs, wherein the reinforcing collar is maintained in position, pressing the single elastic seal ring, by the studs which fix the base flange in the wellhead assembly, and the studs pass through the reinforcing collar.

18. The arrangement of claim 17, including first nuts threadedly engaging the studs and keeping the base flange fixed in the wellhead assembly, and second nuts threadedly engaging the studs and keeping the reinforcing collar in position and pressing the single elastic seal ring.

19. An arrangement providing an in-situ repair of a wellhead assembly disposed above a well, repairing a leak through which gas rises from the well, wherein the wellhead assembly includes a base flange, a production tube passing through the base flange, an intermediate tube surrounding the production tube and engaged with the base flange, an outer tube ending at a location below and spaced from a lower surface of the base flange so that an annular volume is defined between the intermediate tube and the outer tube, and a filler material filling the annular volume, the arrangement comprising:

an annular foam bead disposed between the intermediate tube and the out tube and on the filler material, and located between the filler material and the lower surface of the base flange;

an epoxy resin crown on the annular foam bead and having an upper surface sloping outwardly from an outside surface of the intermediate tube towards an outside surface of the outer tube, thereby avoiding water stagnation between the intermediate tube and the outer tube, and avoiding corrosion of the intermediate tube and the outer tube: and a gas transmission tube extending through the epoxy resin crown and into the annular foam beam, with a first end of the gas transmission tube in the annular foam bead, and a second end of the gas transmission tube located outside the annular foam bead and the epoxy resin crown for transmitting the gas rising from the leak and passing through the annular foam bead.

20. A well comprising an arrangement according to claim 19.

21. A method of in-situ repair of a wellhead assembly, the wellhead assembly including a wellhead, a tube having an outside surface and a longitudinal axis, fasteners, a base flange fixed to the wellhead by the fasteners and secured to the outside surface of the tube, wherein the tube extends from beneath and through the base flange, the base flange extends radially outwardly from an outside surface of the tube and has a planar lower surface which coaxially surrounds the tube and on which outer parts of the fasteners fixing the base flange to the wellhead bear, the outer parts are located a predetermined distance from the outside surface of the tube, a damaged surface area to be repaired is located at a junction of the planar lower surface of the base flange and the outside surface of the tube and includes parts of the planar lower surface of the base flange and the outside surface of the tube, adjacent the junction, the method comprising:

applying a layer of a polymerizable composite material on the damaged surface area at the junction of the planar lower surface of the base flange and the outside surface of the tube, the layer of the polymerizable composite material having layer portions covering the junction and the parts of the outside surface of the tube and the planar lower surface of the base flange between the junction and the outer parts of the fasteners fixing the base flange to the wellhead;

placing a single elastic seal ring on the outside surface of the tube and coaxial with the longitudinal axis of the tube, on the layer of the polymerizable composite material, and in contact with the layer portions; and installing a reinforcing collar on the tube, coaxially surrounding the tube, in contact with and pressing against the single elastic seal ring, exerting a force on the single elastic seal ring and directed towards the junction, and pressing the single elastic seal ring against the layer portions so that the layer portions are pressed against the parts of the outside surface of the tube and the planar lower surface of the base flange.

* * * * *